United States Patent [19]

Yoshieda et al.

[11] Patent Number: 4,655,662

[45] Date of Patent: Apr. 7, 1987

[54] GRIPPER MECHANISM FOR FEEDING ELONGATE STRIPS

[75] Inventors: Keiichi Yoshieda, Kurobe; Toshiaki Sodeno, Toyama; Syuichi Honmoto, Uozu, all of Japan

[73] Assignee: Yoshida Kogyo K.K., Tokyo, Japan

[21] Appl. No.: 765,949

[22] Filed: Aug. 15, 1985

[30] Foreign Application Priority Data

Aug. 29, 1984 [JP] Japan ..... 59-180075

[51] Int. Cl.[4] ..... B23Q 5/22

[52] U.S. Cl. ..... 414/14; 414/15; 414/20; 414/736; 414/753; 294/86.4; 901/31; 901/36; 29/766

[58] Field of Search ..... 414/14, 15, 20, 736, 414/751, 753; 294/86.4; 901/6, 30, 31, 36; 83/153, 277, 921; 29/408, 283, 33.2, 766

[56] References Cited

U.S. PATENT DOCUMENTS

| | | | |
|---|---|---|---|
| 2,959,412 | 11/1960 | Sjostrom | 414/20 X |
| 3,072,002 | 1/1963 | Kuba | 83/153 |
| 3,456,814 | 7/1969 | Bautz | 414/750 |
| 3,495,722 | 2/1970 | Schroder | 414/753 |
| 3,714,698 | 2/1973 | Fukurdi | 29/408 |
| 4,015,721 | 4/1977 | Scheler | 414/753 |
| 4,250,781 | 2/1981 | Nakamura | 83/277 X |
| 4,291,909 | 9/1981 | Coatantiec | 414/753 X |
| 4,300,283 | 11/1981 | Veda | 29/766 |
| 4,381,169 | 4/1983 | Muhr et al. | 414/20 X |
| 4,422,357 | 12/1983 | Larsen | 83/277 X |
| 4,473,249 | 9/1984 | Valenting et al. | 414/753 X |
| 4,505,636 | 3/1985 | Sugino et al. | 414/736 |
| 4,525,195 | 6/1985 | Foster | 414/736 X |
| 4,588,070 | 5/1986 | Smith | 414/753 X |
| 4,604,021 | 8/1986 | Werner | 414/751 X |

FOREIGN PATENT DOCUMENTS

| | | | |
|---|---|---|---|
| 51662 | 4/1977 | Japan | 901/36 |

*Primary Examiner*—Joseph J. Rolla
*Assistant Examiner*—P. McCoy Smith

[57] ABSTRACT

A gripper mechanism for feeding a pair of elongate strips such as a pair of slide fastener stringers has a pair of gripper holders supporting a pair of grippers for gripping the slide fastener stringers, respectively, and a pair of sliders joined to the gripper holders, respectively, and slidably disposed in a housing for independent movement therein. In response to engagement with a cam on a feed path, the grippers are opened to grip or release the slide fastener stringers. The grippers are normally urged by a spring to clamp the slide fastener stringers. A pinion is angularly movably supported on a slide block in the housing and held in mesh with a pair of racks, respectively, of the sliders. A spring acts between the housing and the slide block for normally urging the slide block in a direction to move the gripper holders into abutment against the housing. The gripper holders can be moved relatively to each other toward and away from the housing.

5 Claims, 7 Drawing Figures

GRIPPER MECHANISM FOR FEEDING ELONGATE STRIPS

BACKGROUND OF THE INVENTION

1. Field of the Invention

The present invention relates to a gripper mechanism for gripping and feeding separate elongate strips such as slide fastener stringers in an apparatus for finishing slide fasteners.

2. Description of the Prior Art

One typical gripper mechanism for feeding slide fastener stringers simultaneously over a given distance in timed relation to the operation of a positioning device is disclosed in Japanese Patent Publication No. 49-44243 published on Nov. 27, 1974. The disclosed gripper mechanism includes a pair of grippers for gripping the leading ends of a pair of elongate slide fastener stringers after certain components have been attached to the stringers and then for pulling the slide fastener stringers, along a feed path for the prescribed interval. In response to detection by a positioning device of the slide fastener stringers having travelled over the desired interval, the grippers are stopped, and the slide fastener stringers are cut off across element-free spaces or gaps thereof into individual stringer lengths which are then fed to a discharge position.

Since the slide fastener stringers are composed of woven or knit stringer tapes of textile material, they often tend to be stretched longitudinally under traction when subjected to changes in temperature and moisture while the stringers are being pulled in a finishing process. In particular, slide fastener stringers of elongate dimensions are liable to have different lengths while they are being processed. When the differently stretched stringers are detected by the chain positioning device and stopped at the same time, the element-free tape areas thereof where the stringers are to be cut off are positioned out of transverse alignment with each other. Therefore, the severed tape edges would not be equally spaced from the terminal coupling elements of the following stringers, and hence the terminal coupling elements would be transversely misaligned. For this reason, various fastener components such as end stops, pins and boxes could not be attached to the stringers at proper positions thereon.

SUMMARY OF THE INVENTION

It is an object of the present invention to provide a gripper mechanism for feeding elongate strips such as slide fastener stringers, the gripper mechanism having means for compensating for a longitudinal dimensional difference between slide fastener stringers being pulled by the gripper mechanism.

According to the present invention, there is provided a gripper mechanism for feeding a pair of elongate strips such as a pair of slide fastener stringers, the gripper mechanism having a pair of gripper holders supporting a pair of grippers for gripping the slide fastener stringers, respectively, and a pair of sliders joined to the gripper holders, respectively, and slidably disposed in a housing for independent movement therein. In response to engagement with a cam on a feed path along which the housing is movable, the grippers are opened to grip or release the slide fastener stringers. The grippers are normally urged by a spring to clamp the slide fastener stringers. A pinion is angularly movably supported on a slide block in the housing and held in mesh with a pair of racks, respectively, of the sliders. A spring acts between the housing and the slide block for normally urging the slide block in a direction to move the gripper holders into abutment against the housing. The gripper holders can be moved relatively to each other toward and away from the housing. If there is a longitudinal dimensional difference between the slide fastener stringers gripped and fed by the grippers, then the gripper holders are moved to different strokes with respect to the housing to absorb such a longitudinal dimensional difference.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
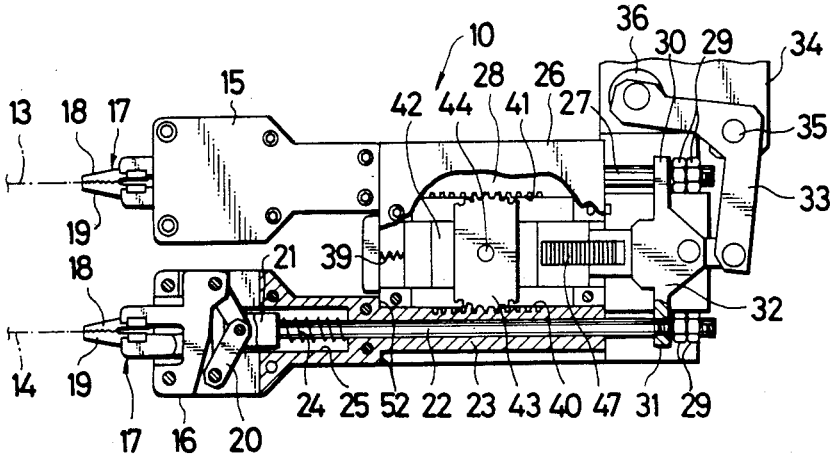
FIG. 1 is a plan view, partly cut away, of a gripper mechanism according to the present invention, the gripper mechanism being shown as pulling slide fastener stringers having no dimensional difference therebetween.
Figure 2:
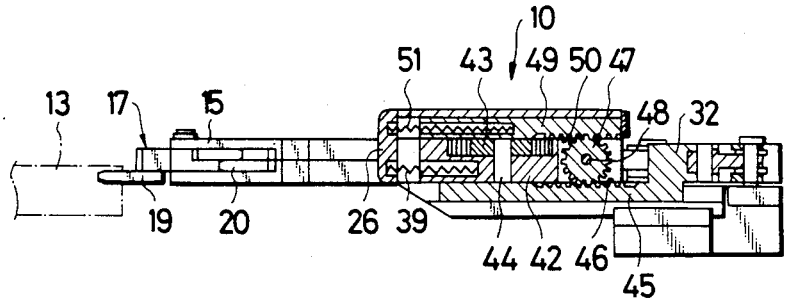
FIG. 2 is a side elevational view, partly in cross section, of the gripper mechanism shown in FIG. 1.

The principles of the present invention are particularly useful when embodied in a gripper mechanism, generally designated by the reference numeral 10, shown in FIGS. 1 and 2.

Figure 7:
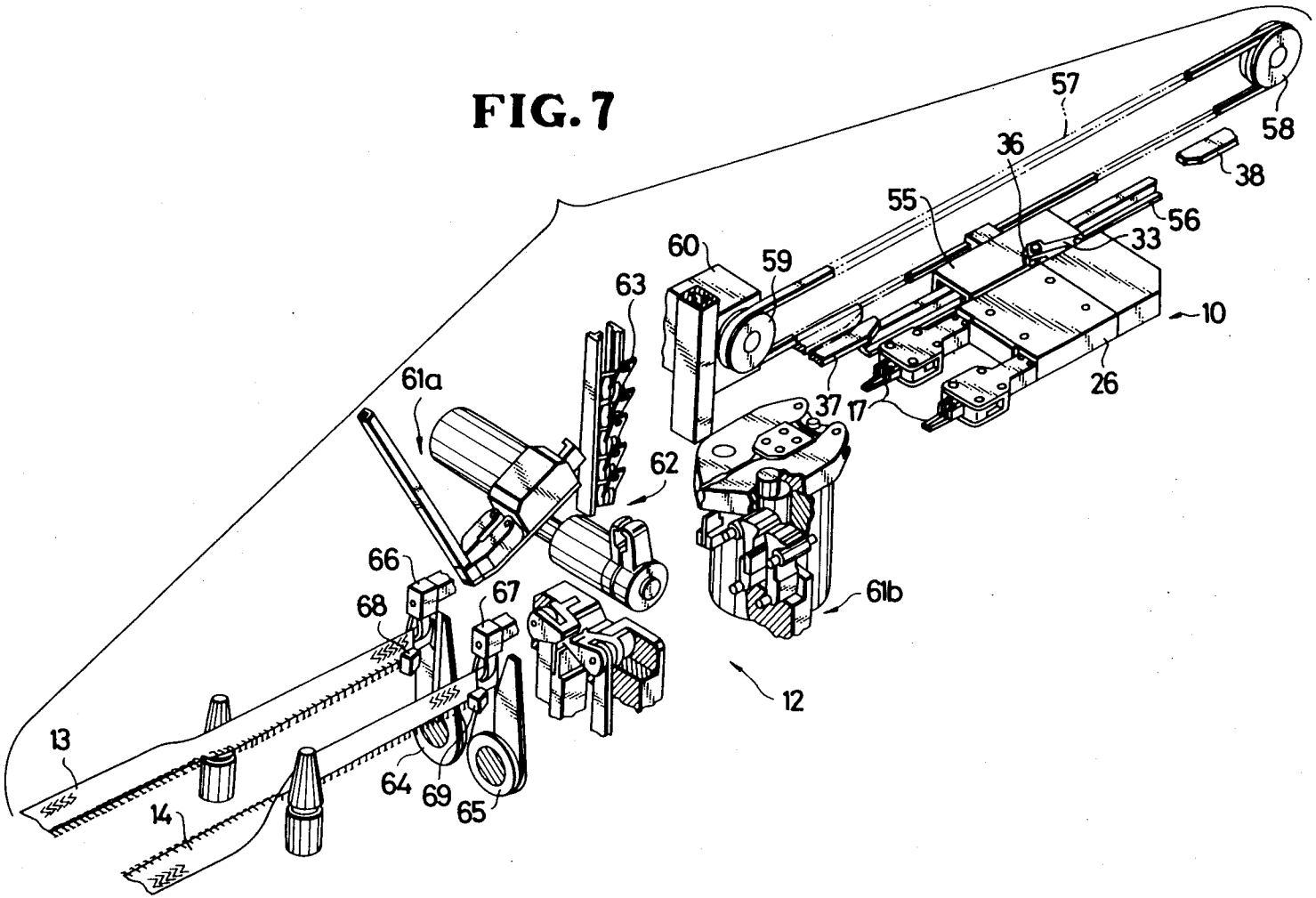
FIG. 7 is an exploded perspective view of a slide fastener finishing apparatus in which the gripper mechanism of the invention is incorporated.

The gripper mechanism 10 is incorporated preferably in a slide fastener finishing apparatus 12 as illustrated in FIG. 7. The gripper mechanism 10 in the finishing apparatus 12 serves to pull a pair of slide fastener stringers 13, 14 with desired components attached thereto in coaction with a positioning device, and also to discharge severed slide fastener stringers of individual lengths out of the finishing apparatus 12.

As shown in FIGS. 1 and 2, the gripper mechanism 10 has a pair of gripper holders 15, 16 each supporting a gripper 17 composed of a pair of gripping jaws 18, 19. The gripping jaws 18, 19 of the gripper 17 supported by the gripper holder 16 are operatively coupled by a linkage 20 to a head 21 attached to a front end of a rod 22 slidably supported by a slider 23.

The linkage 20 is of a conventional construction for converting linear movement of the rod 22 to opening and closing movement of the gripping jaws 18, 19. More specifically, when the head 21 is moved toward the linkage 20, the linkage 20 collapses to move the gripping jaws 18, 19 toward each other. Conversely, when the head 21 is moved away from the linkage 20, the linkage 20 is extended to move the gripping jaws 18, 19 away from each other. The head 21 and hence the rod 22 are normally biased toward the linkage 20 by a compression coil spring 24 disposed around the rod 22 in a cavity 25 defined in the gripper holder 16 and acting between the rear end of the head 21 and the confronting end of the cavity 25. Therefore, the gripping jaws 18, 19 are normally urged under resilient forces toward each other to grip the slide fastener stringer 14.

The slider 23 is joined to the gripper holder 16 and slidably disposed in a housing 26 for sliding movement parallel to the rod 22. The gripper 17 supported by the gripper holder 15 is also operatively coupled to a link (not shown) and a rod 27 which are identical to the link 20 and the rod 22, respectively, the rod 27 being slidably disposed in a slider 28 slidably housed in the housing 26. The slider 28 is slidably movable in the housing 26 parallel to the slider 23.

The rods 22, 27 have rear ends each connected by a pair of nuts 29 loosely to a pair of lateral arms 30, 31 of a shifter 32, with small clearances normally left between the adjacent nuts 29 and the lateral arms 30, 31. The shifter 32 is operatively coupled to one end of a lever 33 pivotably mounted by a pin 35 on a base 34 connected to the housing 26. The other end of the lever 33 is connected to a cam follower 36 engageable with a pair of cams 37, 38 (FIG. 7) which will be described later on.

As illustrated in FIGS. 1 and 2, the parallel sliders 23, 28 include first and second racks 40, 41, respectively, facing toward each other. A slide block 42 is slidably disposed centrally in the housing 26 between the sliders 23, 28. A first pinion 43 is pivotably mounted by a vertical pin 44 on the slide block 42 and is held in mesh with the first and second racks 40, 41. The slide block 42 is normally urged by a compression coil spring 39 to move rearward to the right (FIGS. 1 and 2) with respect to the housing 26. The compression coil spring 39 acts between the housing 26 and the slide block 42. Therefore, the sliders 23, 28 are also resiliently biased to slide rearward, but such rearward sliding movement is limited by shoulders 52 of the gripper holders 15, 16 which engage the housing 26.

The shifter 32 is joined to the rear end of a shifter holder 45 extending longitudinally in the housing 26 and disposed on the bottom of the housing 26, the shifter holder 45 including a lower third rack 46 facing upwardly. The third rack 46 is held in mesh with a second pinion 47 rotatably mounted by a horizontal pin 48 on the slide block 42. A rack holder 49 is slidably mounted in the housing 26 and extends in the longitudinal direction thereof above the slide block 42, the rack holder 49 including an upper fourth rack 50 facing downwardly toward the third rack 46. The fourth rack 50 is held in mesh with the second pinion 47. The rack holder 49 is normally urged by a compression coil spring 51 to move rearward to the right (FIGS. 1 and 2), the compression coil spring 51 acting between the housing 26 and the rack holder 49.

As shown in FIG. 7, the housing 26 is laterally supported on a slide 55 slidably mounted on a guide rail 56 and attached to an endless belt 57 trained around a pair of longitudinally spaced pulleys 58, 59. The pulley 59 is fixedly mounted on the output shaft of a motor 60.

The cams 37, 38 are located in longitudinally spaced-apart positions along the guide rail 56 within the path of movement of the cam follower 36. When the slide 55 is moved along the guide rail 56 forward to the left (FIG. 7) by the belt 57 driven by the motor 60, the gripper mechanism 10 is moved forward along a feed path parallel to the guide rail 56 until the cam follower 36 is engaged by the cam 37 to open the grippers 17. When the slide 55 is moved rearward, the gripper mechanism 10 is moved rearward until the cam follower 36 is engaged by the cam 38 to open the grippers 17 again. While the gripper mechanism 10 is being moved along the guide rail 56 between the cams 37, 38 with the cam follower 36 disengaged therefrom, the grippers 17 remain closed. The cam 37 is transversely movable into the feed path to engage the cam follower 36 for opening the grippers 17 and out of the feed path to release the cam follower 36 to close the grippers 17 for gripping the leading ends of the slide fastener stringers 13, 14.

Figure 5:
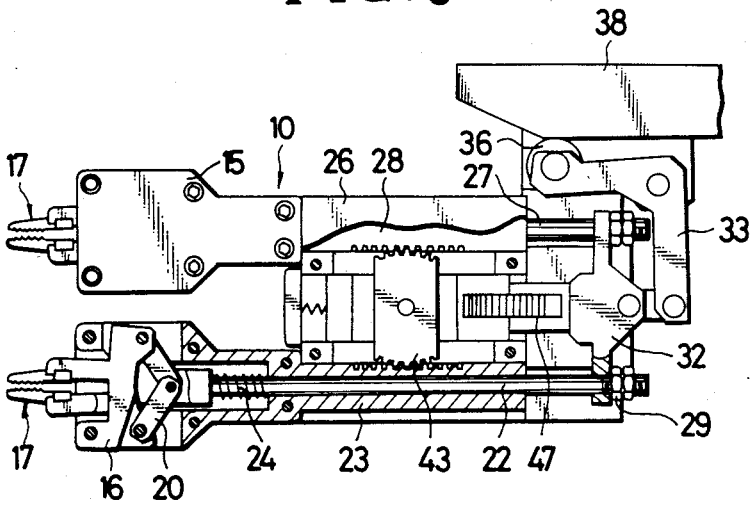
FIG. 5 is a plan view, partly cut away, of the gripper mechanism with a pair of grippers opened.
Figure 6:
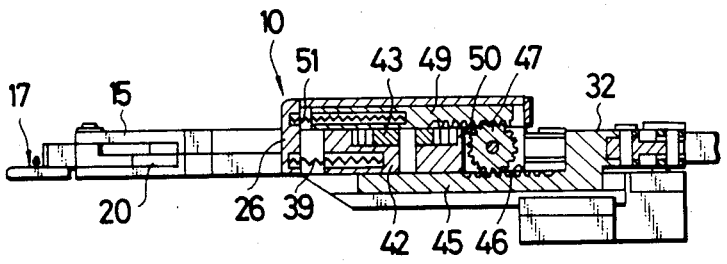
FIG. 6 is a side elevational view, with parts in cross section, of the gripper mechanism illustrated in FIG. 5.

When the cam follower 36 is engaged by the cam 37 or the cam 38, the lever 33 is turned counterclockwise about the pin 35 to move the shifter 32 to the right (FIG. 5). The rods 22, 27 are also moved to the right for opening the grippers 17 through the linkages 20 to release the slide fastener stringers 13, 14. At this time, the shifter holder 45 is also moved to the right with the shifter 32, thus rotating the second pinion 47 which moves the rack holder 49 to the left (FIG. 6) to compress the spring 51. When the cam follower 36 is disengaged from the cam 37 which is moved laterally out of the feed path, the lever 33 is turned clockwise to move the rods 22, 27 to the left under the forces of the springs 24, thereby closing the grippers 17 to grip the leading ends of the slide fastener stringers 13, 14. The grippers 17 remain closed under the forces of the springs 24 for firmly clamping the slide fastener stringers 13, 14. The shifter 32 is moved back to the position of FIG. 1 by the second pinion 47 which is rotated by the rack holder 49 moved to the right by the resilient energy stored in the spring 51. Consequently, the grippers 17 are closed and the shifter 32 is moved back independently of each other. The loose coupling of the rods 22, 27 to the shifter 32 is therefore not required to be adjusted with high accuracy. The clearance between the shifter arms 30, 31 and the nuts 29 allows the grippers 17 to be kept closed even when the shifter 32 is subject to shocks when the gripper mechanism 10 starts pulling, is pulling, and stops pulling the slide fastener stringers 13, 14.

The finishing apparatus 12 includes end stop attachment units **61*a*, 61*b* for attaching end stops to the slide fastener stringers 13, 14 and a slider applicator 62 for mounting sliders 63 successively to the slide fastener stringers 13, 14. The finishing apparatus 12 also has a pair of cutters 64, 65 for cutting off the slide fastener stringers 13, 14, respectively, a pair of grippers 66, 67 movable along the feed path for feeding the slide fastener stringers 13, 14 through the finishing apparatus 12, and a positioning device composed of a pair of detectors 68, 69 for detecting and forcibly stopping the terminal coupling elements of the following coupling element rows on the slide fastener stringers 13, 14**.

The leading ends of the slide fastener stringers 13, 14 are released from the grippers 66, 67 and gripped by the grippers 17 of the gripper mechanism 10 when the cam follower 36 is engaged by the cam 37. After one set of end stops and a slider 63 are mounted on the slide fastener stringers 13, 14 by the end stop attachment units **61*a*, 61*b* and the slider applicator 62, the slide fastener stringers 13, 14 are stopped in the feed path by the positioning device when both of the detectors 68, 69 detect the terminal coupling elements of the next coupling element rows on the stringers 13, 14. More specifically, if the slide fastener stringers 13, 14 as they are fed by the grippers 17 along the feed path are not differently stretched, and hence there is no longitudinal dimensional difference between the slide fastener stringers 13, 14, then the gripper holders 15, 16 remain aligned transversely with each other as shown in FIG. 1, with the first pinion 43 not rotated. Therefore, the terminal coupling elements of the next coupling element row are detected simultaneously by the detectors 68, 69 to de-energize the motor 60, thereby stopping the gripper mechanism 10. Since the terminal coupling elements are engaged by the detectors 68, 69, respectively, at this time, the slide fastener stringers 13, 14 will be cut off accurately across the element-free space area by the cutters 64, 65**.

Figure 3:
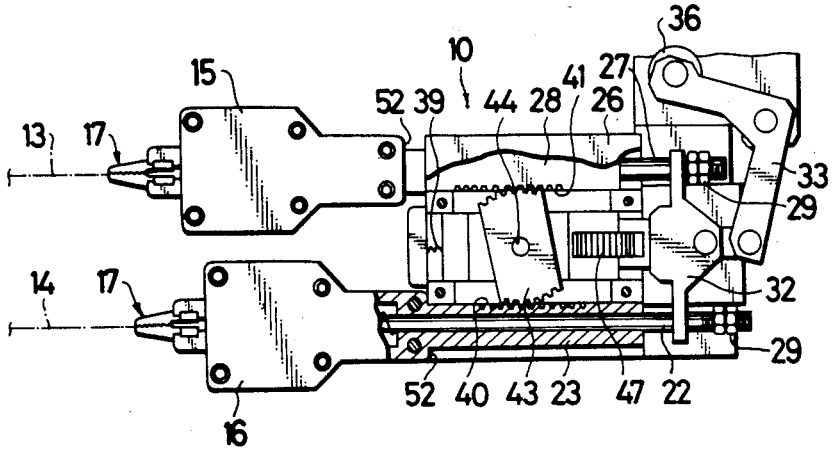
FIG. 3 is a plan view, partly cut away, of the gripper mechanism which is shown as pulling slide fastener stringers having a dimensional difference therebetween.
Figure 4:
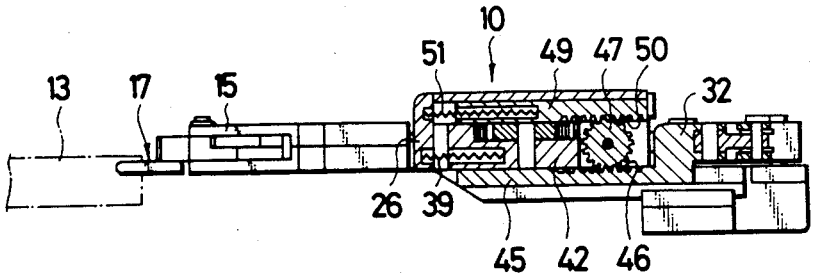
FIG. 4 is a side elevational view, partly in cross section, of the gripper mechanism shown in FIG. 3.

If there is any longitudinal dimensional difference between the slide fastener stringers 13, 14 due for example to different stretching thereof while they are being fed, then the gripper holders 15, 16 are caused to move out of mutual transverse alignment. Specifically, when the slide fastener stringer 14, for example, is stretched longitudinally for some reason as shown in FIG. 3, the terminal coupling element on the slide fastener stringer 13 is first engaged by the detector 68 and the gripper holder 15 is forcibly stopped by the detector 68 engaging the terminal coupling element. The gripper holder 16 with its gripper 17 clamping the stretched slide fastener stringer 14, however, continues to pull the slide fastener stringer 14 until the terminal coupling element thereon is engaged by the detector 69. At this time, since the motor 60 is not de-energized, the gripper mechanism 10 keeps on moving along the feed path to withdraw the gripper holder 16 while the gripper holder 15 is forcibly stopped. Therefore, as the gripper mechanism 10 moves on, the slider 28 is progressively displaced to the left out of the housing 26 as shown in FIG. 3. The first pinion 43 is then turned counterclockwise about the pin 44 as the housing 26 is moved to the right. Inasmuch as the slider 23 cannot be moved to the right due to the engagement of the shoulders 52 with the housing 26, the first pinion 43 causes the slide block 42 to move to the left against the bias of the spring 39. When the terminal coupling elements on the stringers 13, 14 are engaged by the detectors 68, 69, respectively, the motor 60 is de-energized to stop the gripper mechanism 10. Therefore, the slide fastener stringers 13, 14 can be cut off by the cutters 64, 65 accurately at element-free space positions equally spaced from the terminal coupling elements.

When the slide fastener stringers 13, 14 are cut off by the cutters 64, 65, the gripper holder 16 is released and moved to the right under the resiliency of the spring 39 until its shoulders 52 abut against the housing 26 as shown in FIG. 1. The severed slide fastener stringers 13, 14 of unit lengths are then discharged from the gripper mechanism 10 when the grippers 17 are opened by the cam follower 36 engaged by the cam 38. Then, the gripper mechanism 10 is moved forward by the belt 57 until the cam follower 36 is engaged by the cam 37, whereupon the leading ends of the slide fastener stringers 13, 14 are unclamped from the grippers 66, 67 and gripped by the grippers 17.

When the slider 28 of the gripper holder 15 is relatively moved out of the housing 26, the rod 27 is also moved with the gripper holder 15, as shown in FIG. 3. At this time, the shifter 32 is also moved forward and remains out of engagement with the nuts 29 on the rod 27. More specifically, the slide block 42 is moved forward against the bias of the spring 39 upon progressive movement of the slider 28 out of the housing 26, as described above. Therefore, the second pinion 47 meshing with the upper or fourth rack 50 is caused to turn clockwise for thereby moving the shifter holder 45 and hence the shifter 32 forward, which is not engaged by the nuts 29. The gripper 17 of the gripper holder 15 therefore remains closed to grip the slide fastener stringer 13 firmly.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A gripper mechanism for feeding a pair of elongate strips, comprising:

(a) a housing movable along a feed path;

(b) a pair of gripper holders supporting a pair of grippers for gripping the strips, respectively;

(c) a pair of sliders joined to said gripper holders, respectively, and slidably disposed in said housing for movement therein, said sliders including first and second racks, respectively;

(d) means on said housing for opening said grippers in response to engagement with a cam on the feed path, said means including resilient means for normally closing said grippers;

(e) a slide block slidably mounted in said slide housing;

(f) a first pinion angularly movably supported on said slide block and held in mesh with said first and second racks, respectively; and (g) a spring acting between said housing and said slide block for normally urging the slide block in a direction to move said gripper holders into abutment against said housing, whereby said gripper holders can be moved relatively to each other toward and away from said housing.

2. A gripper mechanism according to claim 1, said sliders extending parallel to each other with said first and second racks disposed in confronting relation to each other.

3. A gripper mechanism according to claim 1, said opening means comprising a pair of rods slidably extending through said sliders, respectively, a pair of linkages by which said grippers are operatively coupled to said rods, respectively, a shifter operatively coupled to said rods, a lever pivotably connected to said shifter and angularly movably coupled to said housing, and a cam follower mounted on said lever for engagement with said cam, said shifter being movable to displace said rods in one direction to cause said linkages to open said grippers in response to engagement of said cam follower with said cam.

4. A gripper mechanism according to claim 3, said resilient means comprising springs acting between said gripper holders and said linkages for urging said rods to move in a direction opposite to said one direction to thereby close said grippers.

5. A gripper mechanism according to claim 3, further including a shifter holder slidably disposed in said housing and joined to said shifter, said shifter holder having a third rack, a second pinion rotatably mounted on said slide block and held in mesh with said third rack, a rack holder slidably disposed in said housing and having a fourth rack held in mesh with said second pinion, said shifter holder and said rack holder being slidable parallel to said sliders, and a spring acting between said housing and said rack holder for normally urging said rack holder to move in a direction parallel to said one direction.

* * * * *